United States Patent [19]

Gnesin et al.

[11] 4,189,368

[45] Feb. 19, 1980

[54] SYSTEM OF BUSBARS FOR ALUMINIUM-PRODUCING ELECTROLYZERS

[75] Inventors: Zinovy I. Gnesin; Svetozar V. Evdokimov; Ilya G. Kil; Vladimir P. Nikiforov; Valentin I. Ryabov; Alexandr N. Smorodinov; Igor K. Tsybukov, all of Leningrad, U.S.S.R.

[73] Assignee: Vsesojuzny Nauchno-Issledovatelsky I Proektny Institut Aljuminievoi, Magnievoi I Elektrodnoi Promyshlennosti, Leningrad, U.S.S.R.

[21] Appl. No.: 897,267

[22] Filed: Apr. 18, 1978

[51] Int. Cl.[2] ..... C25C 3/16; C25C 3/06

[52] U.S. Cl. ..... 204/243 M; 204/244

[58] Field of Search ..... 204/243 R-247, 204/67

[56] References Cited

U.S. PATENT DOCUMENTS

| | | | |
|---|---|---|---|
| 3,756,938 | 9/1973 | Nebell | 204/243 M |
| 3,775,280 | 11/1973 | Nikiforov et al. | 204/243 M |
| 4,049,528 | 9/1977 | Morel et al. | 204/67 X |
| 4,072,597 | 2/1978 | Morel et al. | 204/243 M |
| 4,090,930 | 5/1978 | Morel et al. | 204/244 X |

*Primary Examiner*—John H. Mack

*Assistant Examiner*—D. R. Valentine

*Attorney, Agent, or Firm*—Fleit & Jacobson

[57] ABSTRACT

A system of busbars for aluminium-producing electrolyzers located at the ends of groups of series-connected electrolyzers arranged lengthwise in at least two parallel rows, incorporates stacks of cathode buses located to the left and to the right of a longitudinal axis of each row of electrolyzers in the direction of the current flow through the electrolyzers. The system incorporates a busbar jumper connecting the busbars of the first electrolyzer located at the end of one of the two rows of electrolyzers wih the busbars of the second electrolyzer located at the end of the other of the two rows of electrolyzers. The left stack of the second electrolyzer includes a portion which extends along the transverse wall of the electrolyzer towards the longitudinal axis thereof, and a continuing portion extending along said longitudinal axis, whereas the left stack of the first electrolyzer includes a portion which extends lengthwise of the transverse wall of the electrolyzer towards the right stack thereof, and a continuing portion extending together with the right stack of this electrolyzer to its junction with the busbar jumper.

The proposed system permits minimizing the adverse effect of the magnetic field on the melt in the electrolyzer located at the end of the row, at the current outlet.

3 Claims, 1 Drawing Figure

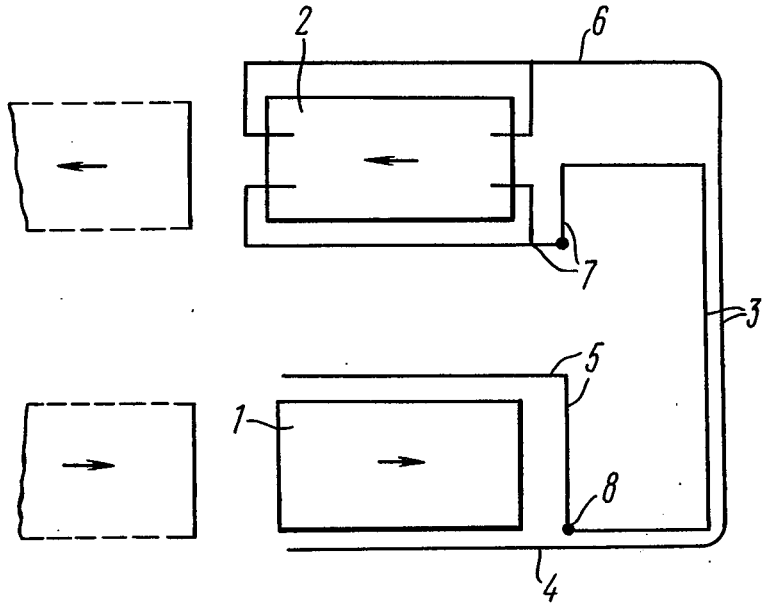
2
6
7
3
5
1
8
4

SYSTEM OF BUSBARS FOR ALUMINIUM-PRODUCING ELECTROLYZERS

The present invention relates to systems of busbars for aluminium-producing electrolyzers and, more particularly, to an arrangement of cathode buses through which current leaves the electrolyzers located at the end of a row of electrolyzers arranged lengthwise in the row.

In the production of aluminium, it is customary to arrange electrolyzers in parallel rows. The electrolyzers in each row are connected in series, i.e., the cathode of one electrolyzer is connected to the anode of the next electrolyzer, whereby electric current flows through an entire row of electrolyzers and returns through the opposite row.

Known in electrochemistry is a system of busbars of aluminium-producing electrolyzers located at the beginning and end of a row of electrolyzers arranged lengthwise in the row, incorporating stacks of cathode buses arranged on either side of the electrolyzers, i.e. to the left and to the right of the longitudinal axis of the electrolyzers, in the direction of the current flow.

In the course of operation of electrolyzers provided with a known system of busbars, powerful electromagnetic fields occur due to heavy currents flowing through the electrolyzer components, which substantially affect the process of aluminium electrolysis.

The higher the power of an aluminium-producing electrolyzer, the more pronounced the adverse effect of the magnetic field upon the process of aluminium electrolysis. Interaction of the magnetic field with the currents flowing through the molten metal in the electrolyzer gives rise to strong electromagnetic forces in the latter. These forces cause distortion of the liquid cathode metal surface and its vigorous circulation.

Considerable warping or buckling of the metal surface causes electrolyzers to operate with an electrode spacing exceeding the optimum one. This leads to a higher voltage per electrolyzer, excessive power consumption and overheated melt, which adversely affects the current yield.

As a result of vigorous circulation, the molten metal is much more liable to entrainment into the anode-adjacent space where it is oxidized by anode gases. Numerous observations have shown that in those zones of an electrolyzer, where the magnetic field intensity and the level of circulating fluxes reach their peak values, the cathode casing wall is deformed, and it is precisely in these zones that the side carbon plates of electrolyzers are most frequently destroyed by the molten metal.

Under the combined effect of gaseous fluxes and electromagnetic forces, waves appear on the surface of the molten aluminium, which may result in local short-circuits that substantially reduce the current yield.

Operation of high-power electrolyzers may be economically warranted only if effective measures are developped to counteract the harmful effect of the magnetic field.

Investigations of the magnetic field, carried out in recent years both on pilot and industrial electrolyzers using heavy current, have made it possible to express the requirements to a system of busbars for an aluminium-producing electrolyzer, as follows:

$$By(0)=0;\ (\delta By/\delta x)=(\delta Bx/\delta y)\rightarrow 0;$$
$$(\delta Bz/\delta x)=(\delta Bz/\delta y)\rightarrow 0$$

where:

$B_y$ is the transverse component of the magnetic field;

$B_x$ is the longitudinal component of the magnetic field;

$B_z$ is the vertical component of the magnetic field.

In other words, the afore-specified requirements boil down to the symmetry of the transverse magnetic field, invariability of values $B_y$ and $B_x$ along the electrolyzer axes and minimum absolute values of $B_z$, effective in the electrolyzer corners, as well as the symmetry of the vertical magnetic field with respect to the electrolyzer axes.

While some ways have been developed to meet the afore-specified requirements for electrolyzers located in the middle of a row, it is still difficult to meet these requirements for electrolyzers located at the beginning and at the end of each row.

A characteristic feature of the end electrolyzers resides in the fact that they face the adjacent electrolyzers with one side only. Besides, the magnetic field set up by the currents flowing along the opposite row of electrolyzers (in a double-row arrangement of electrolyzers in the production room) is, in this case, somewhat lower.

Therefore, the magnetic field in the liquid metal of the electrolyzers located at the beginning and at the end of a row (in particular, the vertical component of the field) loses its symmetry when the known system of busbars is employed without any additional measures taken, which, in turn, unfavourably affects the working characteristics of said electrolyzers.

Known in the art is an improved system of busbars for aluminium-producing electrolyzers. The system ensures a more symmetrical magnetic field acting upon the molten metal in the electrolyzers located at the beginning and at the end of a row (cf. U.S. Pat. No. 3,775,280; Cl. 204/243M). Such a system provides stacks of cathode buses arranged on either side of each row of electrolyzers, i.e., to the left and to the right of the longitudinal axis of an electrolyzer, along the direction of current flow, the left and the right cathode stacks of each electrolyzer being located at the end of the row at the current outlet, extending lengthwise of the transverse wall of the electrolyzer, towards the longitudinal axis thereof and, further, lengthwise of the longitudinal axis, whereas the left stack at the current inlet into the electrolyzer located at the beginning of each row has a configuration symmetrical with the left stack located at the current outlet from the electrolyzer located at the end of the row.

However, direct measurements of magnetic field intensity, carried out on the end electrolyzers have shown that the system fails to overcome the adverse effect of the electromagnetic forces upon the molten metal in the electrolyzers located at the current outlet. This adverse effect is due, to the closeness of the busbar jumper connecting the two opposite rows of electrolyzers.

It is an object of the present invention to minimize the adverse effect of the magnetic field of a busbar system upon the molten metal in the electrolyzers located at the current outlet where a busbar jumper is arranged to connect two opposite rows of electrolyzers.

Another object of the present invention is to ensure the symmetry of the magnetic field acting, upon the molten metal in the electrolyzers located at the current outlet.

Still another object of the present invention is to increase the production efficiency of electrolyzers.

With these and other objects in view, there is proposed a system of busbars for aluminium-producing electrolyzers arranged in at least two parallel rows, the system comprising stacks of cathode buses, located on either side of each row of electrolyzers, i.e., to the left and to the right of the longitudinal axis of the electrolyzers, in the direction of current flow, and connected at the end of each pair of the rows by means of a busbar jumper, wherein, according to the invention, one (left) of the stacks of cathode buses, located at the end of the row at the current outlet and arranged adjacent to the jumper and between the rows of electrolyzers, includes a portion which extends lengthwise of a transverse wall of this electrolyzer towards the outer (right) stack of cathode buses, and a continuing portion extending together with the right stack to its junction with the jumper.

It is expedient that the continuing portion of the left cathode stack and the right cathode stack of the electrolyzer located at the end of the row at the current outlet be positioned on the same level. In this case, use may be made of structurally simpler supports for holding the buses.

Other features and advantages of the invention will be better understood from the following detailed description with reference to the accompanying drawing, which is a diagram of a system of busbars buses for electrolyzers, according to the invention.

Referring now to the drawing, there is shown a system of busbars for electrolyzers 1 and 2 located at the end of a production room where a busbar jumper 3 is provided to connect two opposite rows of electrolyzers. Said system incorporates stacks 4, 5 and 6, 7 of cathode buses arranged to the left and to the right of the longitudinal axis of the electrolyzers, along the current flow.

As shown in the drawing, the left stack 7 supplying electric current to the electrolyzer 2 located at the end of the row at the current inlet has a portion extending lengthwise of the transverse wall of this electrolyzer to its middle. The left cathode stack 5 at the current outlet from the electrolyzer 1, according to the invention, has a portion running the whole length of the transverse wall of the electrolyzer towards the right cathode stack 4 and, further, both of the stacks 4, 5 extend together to the junction with the jumper 3.

In one of the embodiments, the continuing portion of the left cathode stack 5, that is usually located on a somewhat higher level than the right cathode stack 4, may be lowered near the right cathode stack 4 (at the point 8 in the drawing) down to the level thereof and, further, extend together with the right stack 4 on the same level as an assembled busbar.

Current to aluminium-producing electrolyzers is supplied by the system of busbars, according to the present invention, as follows:

As has been mentioned above, the production room accommodates two rows of electrolyzers arranged lengthwise in a row. The direction of the current flow in the stacks of cathode buses of the electrolyzers is indicated by arrows.

Current is taken from the cathode of the electrolyzer 1 by means of the left stack 5 and the right stack 4 of cathode buses, while to the anode of the electrolyzer 2 current is fed via the stacks 6 and 7.

The stack 5 has a portion running the whole length of the transverse wall of the electrolyzer 1, whereas the stack 7 has a portion running half-length of the transverse wall of the electrolyzer 2.

As a result of such an arrangement of the cathode stacks, the magnetic field generated by the currents flowing along these stacks, counteracts the symmetry of the magnetic field vertical component $B_z$ in the molten metal of the electrolyzers, which is due to the absence of second adjacent electrolyzers and to the nearness of the jumper 3.

What is claimed is:

1. In a system of current-supply buses in aluminum-producing electrolyzers having transverse walls and located at the beginning and at the end of a plurality of series-connected electrolyzers arranged in at least two parallel rows along spaced longitudinal axes, wherein said system comprises left and right stacks of cathode buses located at the left and at the right with respect to each of said longitudinal axes of said electrolyzers viewing in the direction of current flow through the electrolyzers, and wherein a busbar jumper connects the left and right stacks of cathode buses of one row of series-connected electrolyzers with the left and right stacks of cathode buses of the other parallel row of series-connected eletrolyzers respectively, wherein the improvement comprises:

a first left stack of cathode buses located at the end of the row of electrolyzers at the current outlet, between the rows of electrolyzers, and arranged adjacent to said busbar jumper;

a first right stack of cathode buses located at the end of the row of electrolyzers at the current outlet, and arranged opposite to said first left stack of cathode buses;

a first portion of said first left stack of cathode buses extending along the entire length of said transverse wall of the electrolyzers located at the end of the row at the current outlet, said portion extending toward said first right stack of cathode buses;

and a second portion of said first left stack of cathode buses extending parallel to said first right stack of cathode buses to a junction with said busbar jumper.

2. A system of buses as claimed in claim 1, wherein said second portion of said first left stack of cathode buses is arranged on the same level with said second right stack of cathode buses.

3. A system of buses as claimed in claim 1, further comprising:

a second left stack of cathode buses located at the end of the other row of electrolyzers at the current inlet, between the rows of electrolyzers and arranged adjacent to said busbar jumper;

a first portion of said second left stack of cathode buses extending along half of the length of said transverse wall of the electrolyzers located at the end of the other row at the current inlet, said first portion of said second left stack of cathode buses extending toward the longitudinal axis of the other row of electrolyzers; and a second portion of said second left stack of cathode buses extending lengthwise along the longitudinal axis of said other row to a junction with said busbar connector.

* * * * *